United States Patent [19]

Fürbringer et al.

[11] Patent Number: 4,881,993

[45] Date of Patent: Nov. 21, 1989

[54] EXPLOSIVE AND PROPELLANT COMPOSITION AND METHOD OF PREPARATION

[75] Inventors: Claude Fürbringer, Riehen; Horst Pauling, Bottmingen, both of Switzerland

[73] Assignee: Hoffman-LA Roche Inc., Nutley, N.J.

[21] Appl. No.: 373,851

[22] Filed: Jun. 29, 1989

[30] Foreign Application Priority Data

Jun. 30, 1988 [CH] Switzerland ..... 2496/88

[51] Int. Cl.[4] ..... C06G 31/28

[52] U.S. Cl. ..... 149/46; 149/61; 149/109.6

[58] Field of Search ..... 149/109.6, 46, 61

[56] References Cited

U.S. PATENT DOCUMENTS 4,497,676 2/1985 Kurtz ..... 149/109.6

4,728,376 3/1988 Kurtz ..... 149/109.6

*Primary Examiner*—Stephen J. Lechert, Jr.

*Attorney, Agent, or Firm*—Jon S. Saxe; George M. Gould; Bernard S. Leon

[57] ABSTRACT

The carbonyl compounds 5,6-carbonyl-ascorbic acid and 5,6-carbonyl-erythorbic acid been found useful for the preparation of explosive and propellant materials by admixing them with nitrate-containing oxidation agents and optionally further ingredients.

13 Claims, No Drawings

EXPLOSIVE AND PROPELLANT COMPOSITION AND METHOD OF PREPARATION

BACKGROUND OF THE INVENTION 1. Field of the Invention the present invention is concerned with the use of carbonyl compounds, namely of 5,6-carbonyl-ascorbic acid or 5,6-carbonyl-erythorbic acid, in an explosive and propellant composition (e.g., for blasting, ballistics or pyrotechnics), as well as a process for the production of such a composition. 2. State of the Art U.S. Pat. No. 4,497,676 and European Patent Publication No. 268,996 describe explosive materials based on ascorbic acid or erythorbic acid, which are produced by heating ascorbic acid or erythorbic acid together with a nitrate-containing oxidation agent, or by mixing a degradation Product, obtained by heating ascorbic acid or erythorbic acid, with a nitrate-containing oxidation agent.

SUMMARY OF THE INVENTION

It has now been discovered that a qualitatively better product can be obtained by using, in place of ascorbic acid or erythorbic acid, the corresponding 5,6-carbonyl derivative, namely 5,6-carbonyl-ascorbic acid or 5,6-carbonyl-erythorbic acid, which forms the basis of the present invention.

This invention accordingly provides new and improved explosive and propellant compositions comprising 5,6-carbonyl-ascorbic acid or 5,6-carbonyl-erythorbic acid and a nitrate-containing oxidation agent, as well as a process for the manufacture of explosive materials which comprises mixing 5,6-carbonyl-ascorbic acid or 5,6-carbonyl-erythorbic acid with a nitrate-containing oxidation agent and, if desired, with further additives.

DETAILED DESCRIPTION OF THE INVENTION 5,6-Carbonyl-ascorbic acid and its preparation are known from Japanese Patent Publication 7031601 (13.10.1970), abstracted in C.A. 74 (1971) Ref. 88 266 C.

The corresponding erythorbic acid derivative can be prepared using the same method.

As the nitrate-containing oxidation agent there is preferably used an alkali or alkaline earth metal nitrate, especially potassium nitrate, or ammonium nitrate or a mixture of these nitrates. Organic nitrates can be used as further nitrate-containing oxidation agents. The term "organic nitrate"means any usual, carbon-containing nitrate having a stoichiometric excess of oxygen which is normally utilized in the pyrotechnic industry or in the explosive industry. Examples of suitable organic nitrates are nitrocellulose, nitroglycerine or pentaerythritol tetranitrate.

The nitrate-containing oxidation agent and the carbonyl compound are preferably used in a weight ratio between about 40:60 and about 80:20, preferably between about 60:40 and about 65:35.

As mentioned, the explosive and propellant composition in accordance with the invention comprises a mixture of 5,6-carbonyl-ascorbic acid or 5,6-carbonyl-erythorbic acid and a nitrate-containing oxidation agent, but it can also contain, if desired, one or more additives. The mixture in accordance with the invention can, for instance, contain additives such as gelling agents or stabilizers such as Arkardit® or Centralit®; substituted urethanes, phthalates, polymers, illuminating additives such as sodium, barium, strontium or copper salts, as well as other additives, such as these for increasing the energy of explosion or for improving other desired properties, for example, boron or nitroguanidine.

The composition of the invention can be used in a variety of explosive and propellant applications, including as a blasting material, for instance, in mining, as a firing or propellant material, as a pyrotechnic material, or as an energy-rich mixture for various propellant purposes. To indicate a few specific applications, this composition can be used for the production of shells or cartridges, for illuminating or signal munitions, for rockets, for blasting devices, and for fireworks.

The composition of the invention is characterized by low corrosivity upon contacting with metal surfaces such as gun barrels, high propellant force and low smoke evolution. Compared with similar known explosive materials it has, in particular, the following advantageous properties: higher explosive power, distinctly lower hygroscopicity and better stability.

EXAMPLE 74.4 g of potassium nitrate and 44.75 g of 5,6-carbonyl-ascorbic acid were dissolved in 372 ml of water and subsequently treated with 22.4 ml of 1N aqueous potassium hydroxide solution. The solution was evaporated to dryness, first in a water-jet vacuum, then in a high vacuum. The resulting white residue was ground in a mortar and then dried over silica gel for at least 20 hours at 40° C. in a vacuum drying oven. This yielded 120 g of an explosive material having a heat of explosion of 769 cal/g. Water-solubility: about 67 g/100 ml (25° C.).

We claim:

1. An explosive and propellant composition which comprises an admixture of 5,6-carbonyl-ascorbic acid or 5,6-carbonyl-erythorbic acid and a nitrate-containing oxidation agent.

2. A composition according to claim 1, wherein the nitrate-containing oxidation agent is an alkali or alkaline earth metal nitrate.

3. A composition according to claim 2, in which the nitrate-containing oxidation agent is an alkali metal nitrate.

4. A composition according to claim 3, in which the nitrate-containing oxidation agent is potassium nirate.

5. A composition according to claim 1, in which the nitrate-containing oxidation agent is ammonium nitrate.

6. A composition according to claim 1, wherein the weight ratio nitrate-containing oxidation agent to carbonyl compound is between about 40:60 and about 80:20.

7. A composition according to claim 6, in which the weight ratio of nitrate-containing oxidation agent to carbonyl compound is between about 60:40 and about 65:35.

8. A process for the preparation of an explosive and propellant composition, which process comprises forming an admixture of 5,6-carbonyl-ascorbic acid or 5,6-carbonyl-erythorbic acid with a nitrate-containing oxidation agent.

9. A process according to claim 8, wherein the nitrate-containing oxidation agent is an alkali or alkaline earth metal nitrate.

10. A process according to claim 9, in which the nitrate-containing oxidation agent is an alkali metal nitrate.

11. A process according to claim 10, in which the nitrate-containing oxidation agent is potassium nitrate.

12. A process according to claim 9, wherein the nitrate-containing oxidation agent and the carbonyl compound are used in a weight ratio between about 40:60 and about 80:20.

13. A process according to claim 12, in which the weight ratio of nitrate-containing oxidation agent to carbonyl compound is between about 60:40 and about 65:35.

* * * * *